US005933177A

United States Patent [19]

Pollutro et al.

[11] Patent Number: 5,933,177

[45] Date of Patent: Aug. 3, 1999

[54] ERASE UNIT FOR ION DEPOSITION WEB-FED PRINT ENGINE

[75] Inventors: Dennis C. Pollutro, Cherry Creek; Theodore F. Cyman; Kevin J. Hook, both of Grand Island; Orrin D. Christy, North Tonawanda, all of N.Y.

[73] Assignee: Moore Business Forms, Inc., Grand Island, N.Y.

[21] Appl. No.: 07/986,489

[22] Filed: Dec. 7, 1992

[51] Int. Cl.[6] ..... B41J 2/415

[52] U.S. Cl. ..... 347/123; 347/125; 347/126

[58] Field of Search ..... 346/159; 355/221; 313/293, 634; 250/324, 325; 347/123, 125, 126

[56] References Cited

U.S. PATENT DOCUMENTS

| | | | |
|---|---|---|---|
| 3,668,008 | 6/1972 | Severynse . | |
| 3,725,951 | 4/1973 | McCurry | 346/159 |
| 3,815,145 | 6/1974 | Tisch et al. | 346/159 |
| 4,168,973 | 9/1979 | Simm et al. | 250/325 |
| 4,357,618 | 11/1982 | Ragland | 346/159 |
| 4,365,549 | 12/1982 | Fotland et al. | 101/1 |
| 4,409,604 | 10/1983 | Fotland | 346/159 |
| 4,413,897 | 11/1983 | Kohyama | 355/3 |
| 4,435,723 | 3/1984 | Seimiya et al. | 346/154 |
| 4,466,729 | 8/1984 | Iwata | 355/3 |
| 4,516,847 | 5/1985 | Maczuszenko et al. | 346/159 |
| 4,538,163 | 8/1985 | Sheridon | 346/159 |
| 4,675,703 | 6/1987 | Fotland | 346/159 |
| 4,734,722 | 3/1988 | Maczuszenko et al. | 346/159 |
| 4,772,901 | 9/1988 | Boyer et al. | 346/159 |
| 4,792,860 | 12/1988 | Kuehnle | 346/155 X |
| 4,864,331 | 9/1989 | Boyer et al. | 346/159 |
| 4,899,186 | 2/1990 | Walcott | 346/159 |
| 4,918,468 | 4/1990 | Miekka et al. | 346/159 |
| 5,014,076 | 5/1991 | Caley, Jr. et al. | 346/159 |
| 5,027,136 | 6/1991 | Fotland et al. | 346/159 |
| 5,107,284 | 4/1992 | Cyman et al. | 346/159 |
| 5,243,365 | 9/1993 | Christy et al. | 346/159 |
| 5,352,953 | 10/1994 | Wakabayashi et al. | 313/631 |

FOREIGN PATENT DOCUMENTS

| | | | |
|---|---|---|---|
| 0 428 369 A3 | 5/1991 | European Pat. Off. . | |
| 1223700 | 6/1960 | France | 346/159 |
| 403231871 | 10/1991 | Japan | 346/159 |
| 403247470 | 11/1991 | Japan | 346/159 |
| 1 527 724 | 10/1978 | United Kingdom . | |
| PCT/SE87/00595 | 6/1988 | WIPO . | |

OTHER PUBLICATIONS

Patent Abstracts of Japan Publication No. JP60052870, Published Mar. 26, 1985.

Patent Abstracts of Japan Publication No. JP58174975, Published Oct. 14, 1983.

*Primary Examiner*—Randy W. Gibson

*Attorney, Agent, or Firm*—Nixon and Vanderhye P.C.

[57] ABSTRACT

An erase unit for an ion deposition web-fed print engine includes a plenum extending the width of the electrostatic image on the image cylinder and defining an ionization chamber with the image cylinder surface. The plenum has first and second electrodes separated by a dielectric. Upon application of a time-varying potential having a frequency of 0.2 to 50 mHz across the electrodes, ionization occurs, causing an ion current flowing in relation to the image surface until the image surface and the biasing electrode are at the same potential, thus erasing any residual electrostatic image on the cylindrical surface. By providing a DC biasing voltage, the residual electrostatic image may be erased when equalization occurs, with the image cylinder maintaining a pre-charged potential.

20 Claims, 2 Drawing Sheets

22
18
10
20
24
5
12
14
16
17

24
4
29
40
34
32
31
37
12
42
4

ERASE UNIT FOR ION DEPOSITION WEB-FED PRINT ENGINE

BACKGROUND AND SUMMARY OF THE INVENTION

The present invention relates to an ion deposition web-fed print engine having a novel and improved erase unit for removing residual electrostatic potential of an image remaining on the engine's image cylinder after the toner developed latent image has been transferred to a substrate.

Ion deposition printers conventionally transpose or transform computer-generated signals, such as word processing signals, for image printing on a substrate, for example, paper. More particularly, an ion deposition print engine typically includes an image cylinder mounted in opposition to an impression cylinder, with the substrate, i.e., a web of paper, passing between the image and impression cylinders. The image cylinder includes a dielectric layer which receives an electrostatic image from an ion cartridge. The cartridge is driven electronically from the computer or word processing system. The electrostatic image imposed on the image cylinder is contacted with toner from a supply. At the nip between the image and impression cylinders, the toner is transferred to the substrate, i.e., the paper, in the identical form of the electrostatic image on the image cylinder and fused to the substrate. Further rotation of the image cylinder causes it to pass a multi-component cleaning station, which physically removes residual solid particulate matter (i.e., toner). The image cylinder finally passes in opposition to an erase unit, which removes any residual electrostatic potential of the image on the image cylinder surface, whereby a fresh electrostatic image may be placed on the dielectric layer by the ion cartridge. The process is then repeated with the same or different images. The present invention is particularly concerned with a novel and improved erase unit for the ion deposition print engine.

Presently known erase units for ion deposition print engines use a high-density ion current generator to erase the latent residual electrostatic image remaining on the image cylinder after transfer of the image to the substrate. One such known erase unit comprises a central glass rod with four individual glass-coated erase wires mounted 90° apart around the central glass rod and wrapped with a spiral-coiled screen wire. To erase the residual electrostatic potential remaining on the image cylinder, the erase wire is activated by application of high voltage RF energy. This causes atmospheric breakdown and ionization on the surface of the glass-coated erase wire at the junctions of the spiral screen wire. The resultant pool of ions, both positive and negative, migrate to the residual electrostatic image areas on the drum surface as a result of the net electrical field present between the screen wire and the residual electrostatic images.

While acceptable in that configuration, the above-described erase unit has certain limitations. For example, the life of the erase unit is somewhat limited. When one of the erase wires is no longer effective, the unit is rotated 90° to bring the adjacent wire into close proximity with the drum. A disadvantage with this type of erase unit is the downtime involved in order to displace the next wire into position. Also, the glass-coated wire with the spiral wire wrapping is prone to contamination and readily and easily damaged. If contaminated, the erase unit is substantially non-recoverable. Further, there is a limitation in the voltage range for pre-charging the image cylinder. Still further, the operation of this known erase unit is in ambient conditions. This makes it prone to unusual and undesirable deposition of ionic compounds, particularly in ammonia and amine-laden atmospheres. Moreover, the operation is at relatively low frequency, thus limiting overall output.

According to the present invention, there is provided a novel and improved erase unit for an ion deposition print engine which minimizes or eliminates the foregoing and other problems associated with prior erase units for similar type print engines. Particularly, the present invention provides front and rear, or first and second, electrodes and a circuit for providing a time-varying potential across the electrodes. The first electrode may form the base of a plenum into which inert gas, preferably argon, is provided for generating positive and negative ions within the plenum adjacent the image surface containing the residual electrostatic potential in response to the creation of an electric field within the plenum. The second, or front electrode, also called the biasing electrode, is disposed within the plenum and separated from the first, or rear, electrode by a dielectric, for example, formed of glass. Side and end walls are also provided to further define the plenum whereby the region within the plenum filled with the argon (inert) gas lies in contact with the image cylinder. When the circuit is activated, positive and negative ions are generated adjacent the second, or bias, wire and the electric field between the bias wire and the image drum surface provides the driving force for those ions of appropriate polarity to migrate to the cylinder. The ions created within the plenum are also under the influence of the electric field created by the second electrode and the image cylinder assembly by a DC biasing voltage. That field is a function of the residual image cylinder voltage and the erase bias on the second electrode and the distance between the second electrode and the image surface. As long as there is a difference between the residual image cylinder voltage and the erase bias on the second electrode, a net ion migration to the image cylinder surface occurs. As the image cylinder voltage reaches the value of the erase bias by the charging or discharging of the net ionic migration, the ion current will stop. Thus, in a pure eraser application, the bias or second electrode wire is held near a ground potential to produce a zero volt condition on the image drum. It is, however, also important in certain applications to adjust a pre-biasing potential to a specific level for use with other parts of the imaging and development process. Thus, the erase bias potential can be set to a specific level necessary for another part of the process and the image cylinder will be charged or discharged to that desired level. That is, by driving the second wire with the DC bias, the residual image potential on the drum is erased and brought to a biased condition with a surface voltage matching that of the bias wire.

By using a system of the foregoing described type, there is provided an improved apparatus demonstrating higher density ionic output based on the use of inert gas, affording higher frequency RF energy and an improved configuration of the bias wire, resulting in an erasing operation at higher print speeds and a more efficient eraser mechanism. Additionally, the image cylinder may be pre-charged to a wide range of DC surface voltages by biasing the bias wire and creating a net electric field between the wire and the cylinder. Further, the erase unit hereof is substantially insensitive to harmful gases in the ambient environment and creates an equal and uniform output along its length due to its simple construction and the use of the inert gas environment. Still further, the improved eraser unit hereof affords greater operational longevity in comparison with the previously described eraser units because of the insensitivity of the materials used to degradation over time and the robust nature of the plasma-generating components, hence achieving less sensitivity to contamination and affording the capability of cleaning the unit should it become contaminated.

In a preferred embodiment according to the present invention, there is provided an electrostatic ion deposition printer including an electrostatic print head for forming an electrostatic image, an image cylinder rotatable about an axis and having a dielectric layer for receiving the electrostatic image and means for transferring the image to a substrate, an erase unit for removing residual electrostatic potential of the image remaining on the image cylinder after the image has been transferred to the substrate, comprising first and second electrodes disposed adjacent a surface of the image cylinder at a location in opposition thereto and to the residual electrostatic potential remaining on the image cylinder, a dielectric disposed between the first and second electrodes and means for introducing a gas in a region adjacent the second electrode and between the dielectric and the image cylinder surface. Circuit means provide a time varying potential across the electrodes to ionize the gas in the region and enable substantial equalization of the residual potential on the image cylinder surface and the potential on the second electrode.

In a further preferred embodiment according to the present invention, there is provided an electrostatic ion deposition printer including an electrostatic print head for forming an electrostatic image, an image cylinder rotatable about an axis and having a dielectric layer for receiving the electrostatic image, means for transferring the image to a substrate and an erase unit, including first and second electrodes disposed adjacent a surface of the image cylinder at a location in opposition thereto and to the residual electrostatic potential remaining on the image cylinder and a dielectric disposed between the first and second electrodes, a method for removing residual electrostatic potential remaining on the image cylinder after the image has been transferred to the substrate, comprising the steps of introducing a gas in a region adjacent the second electrode and between the dielectric and the image cylinder surface and providing a time varying potential across the electrodes to ionize the gas in the region and enable substantial equalization of the residual potential on the image cylinder surface and the potential on the second electrode.

Accordingly, it is a primary object of the present invention to provide a novel and improved erase unit for an ion deposition web-fed print engine.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
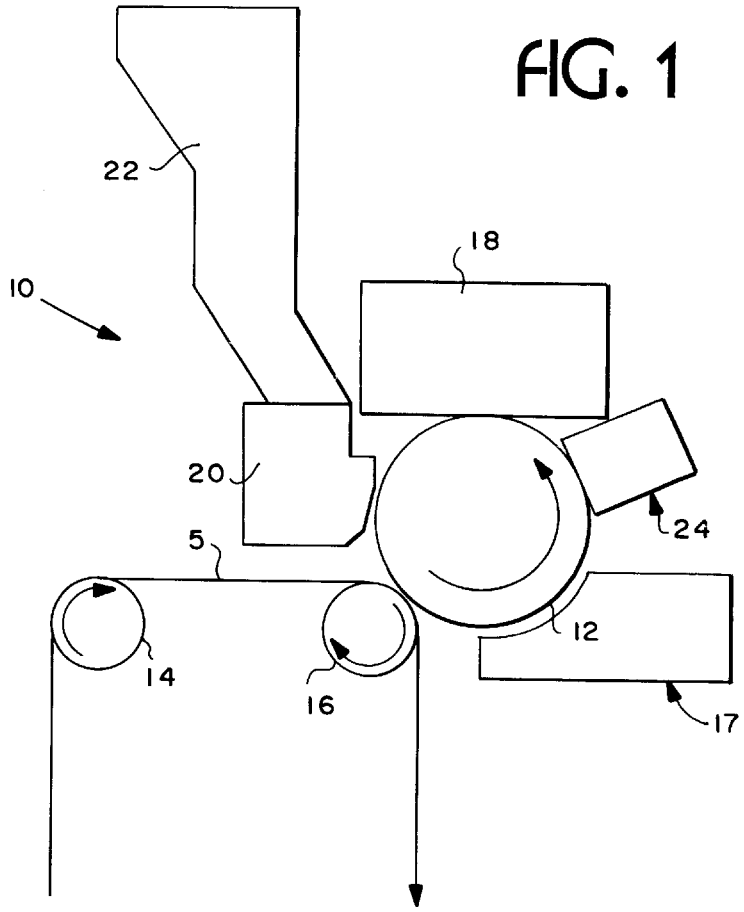
FIG. 1 is a schematic illustration of the component parts of an ion deposition web-fed print engine which are disposed about an image cylinder for transferring the image to a web and erasing residual electrostatic potential on the image cylinder.
Figure 3:
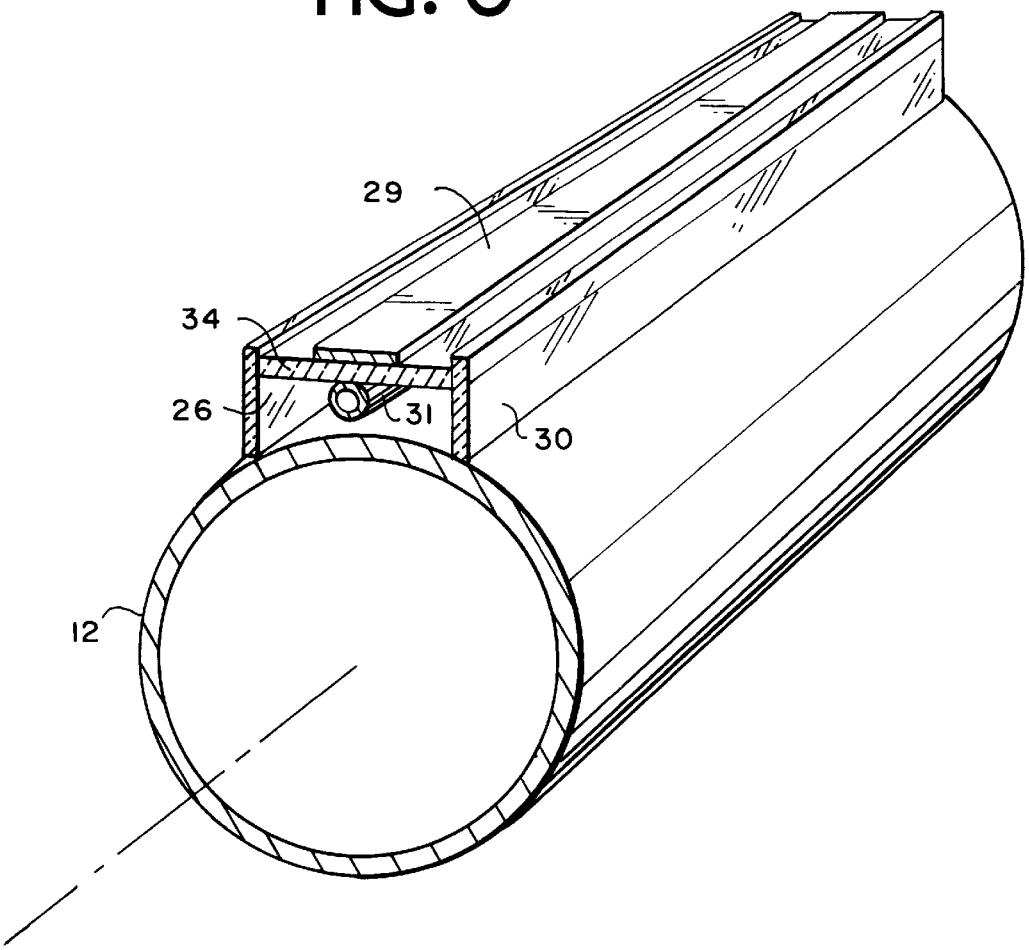
FIG. 3 is a perspective view of an erase unit applied to an image cylinder.
Figure 4:
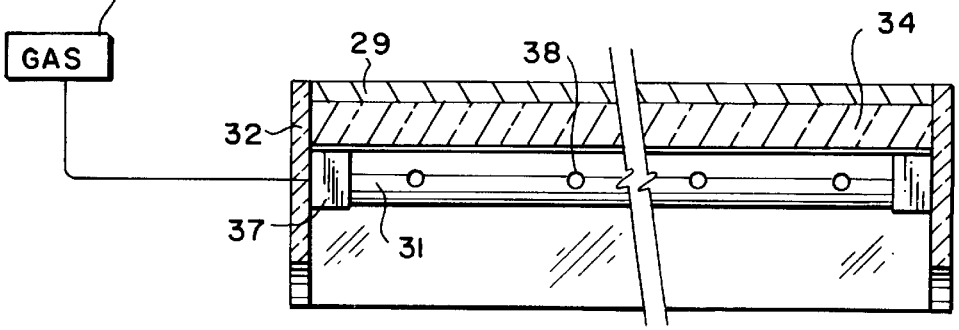
FIG. 4 is a longitudinal cross-sectional view of the erase unit hereof with parts broken out and in cross-section for clarity.

Referring now to FIG. 1, there is illustrated a portion of an ion deposition web-fed print engine, generally designated 10, and which includes an image cylinder 12 for printing an image on a substrate S, in this case, a web of paper passing over rolls, one of the rolls being illustrated at 14. As the paper passes through the nip between the pressure roll 16 and image cylinder 12, an electrostatic image is formed on the image cylinder 12 in a conventional manner by means of a print head 18. The electrostatic image on image cylinder 12 is developed by the application of toner at 20 received from a supply 22. The toner is transferred to the substrate, i.e, the paper S, at the nip of the image cylinder 12 and pressure cylinder 16. Untransferred residual toner and other contaminants are removed from the image cylinder by a cleaning unit 17. Any residual electrostatic potential remaining on the image cylinder 12 is removed by an erase unit 24 before the image cylinder lies once again in opposition to the print head for receiving another electrostatic image. The erase unit 24 of the present invention is illustrated in FIGS. 2–4.

Referring now to those drawing figures, there is illustrated an erase unit 24 in radial opposition to the image cylinder 12. The erase unit 24 includes, as best illustrated in FIG. 3, an elongated plenum 26, which extends parallel to the axis of rotation of the image cylinder 12 a distance at least equal to the transverse extent of the image on the cylinder 12. The plenum 26 is comprised of a back wall, not shown, side walls 30, and a rear wall formed of dielectric material 34. The side and end walls 30 and 32 are preferably formed of glass. The rear wall includes a first, or rear, electrode 29 of a pair of electrodes comprising first and second electrodes 29 and 31. Electrode 29 comprises a metal strip extending along the rear face of dielectric 34. Thus, the first electrode 29 extends between the side walls 30 and end walls 32 and is spaced a further distance from the surface of the image cylinder 12 than the second electrode 31. The second electrode 31, that is, the bias electrode, is disposed within the plenum and separated from the first electrode 29 by a dielectric 34. The second or bias electrode 31 lies within the plenum 32 on the inside of dielectric 34 and between the opposite side and end walls 30 and 32.

The plenum is designed to confine an inert gas, preferably argon, in the region of the second or bias electrode 31 using the dielectric 34 and the side and end walls 30 and 32, respectively, as the gas confining elements. The side and end walls, of course, terminate at their distal ends in close proximity to but spaced from the image cylinder surface. To maintain a supply of the inert gas within the plenum, and in accordance with the present invention, the second or bias electrode 31 is provided in hollow tubular form and has one end connected to a supply of argon gas 36 (FIG. 4). The tube 31 is supported by the dielectric, to which it is secured by spaced mechanical clips 37. As illustrated, the electrode 31 extends the full length of the plenum and has a plurality of apertures 38 spaced longitudinally one from the other along the length of the electrode 31 and along opposite sides thereof. Consequently, gas supplied from source 36 flows into one end of the electrode 31 and through the apertures 38 into the region adjacent the second electrode within the plenum for contact with the image surface of image cylinder 12.

Figure 2:
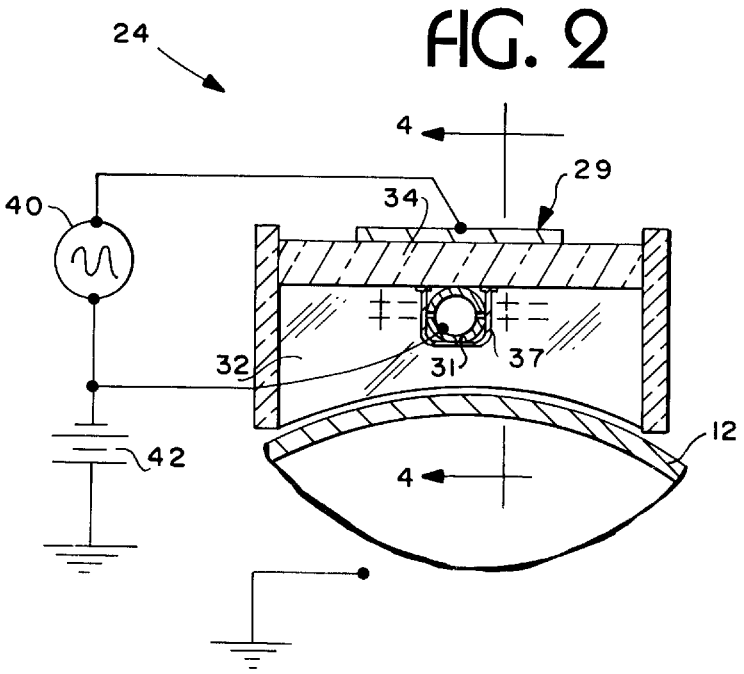
FIG. 2 is a fragmentary transverse cross-sectional view through the image cylinder and an erase unit according to the present invention.

Referring now to FIG. 2, there is provided a circuit for providing a high-frequency time-varying potential of about 0.2 to 50 mHz across the electrodes 29 and 31 to ionize the gas within the plenum. For this purpose, a suitable AC source 40 is coupled to the first electrode 29. The AC source 40 is also connected to the second or bias electrode 31. A DC bias voltage may also be applied to the second electrode from a source 42 to create an electric field between the second or biasing electrode 31 and the image cylinder 12.

In operation, the image cylinder 12 rotates past the print head 18, where it receives the latent electrostatic image, which is developed on the drum surface as it rotates past the toner supply unit. The image is then transferred to the substrate S at the nip of the image cylinder and pressure roll 16. After removing residual toner at cleaning unit 17, further rotation of the image cylinder brings the portion of the cylinder containing any residual electrostatic image in opposition to the erase unit 24.

By applying high-frequency, about 0.2 to 50 mHz high-voltage from the AC source to the electrodes 29 and 31, the inert argon gas within the plenum is excited to generate both positive and negative ions, particularly in the areas of high electric field gradients near the second or biasing electrode 31 and the surface of the dielectric insulator 34. The ions in that volume are also influenced by the electric field created between the second or biasing electrode 31 and the image cylinder surface by the DC biasing voltage 42. It will be appreciated that the electric field is a function of the residual image cylinder voltage, the erase bias applied on the second or bias electrode 31, and the distance between the bias electrode 31 and the image cylinder surface. Provided there is a difference between the residual image cylinder voltage and the erase bias on the second or bias electrode 31, there will be a net ion migration to the image cylinder surface. As the image cylinder voltage or potential reaches the potential of the erase bias by the charging or discharging from the net ionic migration, the ion current will stop. Thus, the resulting electric field between the bias electrode 31 and the image drum surface provides the driving force for those ions of appropriate polarity to migrate to the cylinder surface. Where it is desired to maintain the image cylinder potential at zero, the bias electrode is maintained near or at a ground potential to produce a zero volt condition on the image drum. Consequently, any and all residual charges on the image cylinder will be discharged to a zero potential. If it is desirable to use other image cylinder charge levels to adjust a pre-biasing potential to a specific level for use with other parts of the imaging and development process, the second or bias wire 31 may be driven by the DC power supply 42. In that instance, the ion flow will continue until there is substantial equalization of the residual potential on the image cylinder surface and the potential on the second electrode 31. Once that equalization is obtained, the drum image is erased and remains in a biased condition, with a surface voltage matching that of the second electrode.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In an electrostatic ion deposition printer including an electrostatic print head for forming an electrostatic image, an image cylinder rotatable about an axis and having a dielectric layer for receiving the electrostatic image and means for transferring the image to a substrate, the combination with said printer of an erase unit for removing residual electrostatic potential of the image remaining on the image cylinder after the image has been transferred to the substrate, comprising:

a plenum having first and second electrodes disposed adjacent a surface of said image cylinder at a location in opposition thereto and to the residual electrostatic potential remaining on said image cylinder;

a dielectric disposed between said first and second electrodes;

means for introducing an inert gas in said plenum in a region adjacent said second electrode and between said dielectric and said image cylinder surface; and circuit means for providing a time varying potential across said electrodes to ionize the gas in said region and enable substantial equalization of the residual potential on said image cylinder surface and the potential on said second electrode, whereby the residual electrostatic potential of the image remaining on the image cylinder after the image has been transferred to the substrate is removed.

2. An erase unit according to claim 1 wherein the residual potential on said image cylinder surface is zero and the potential on said second electrode upon equalization is zero.

3. An erase unit according to claim 1 wherein the potential on said image cylinder surface is other than zero when the residual potential on said image cylinder surface and the potential of said second electrode are substantially equalized.

4. An erase unit according to claim 1 wherein said plenum includes said dielectric and at least one wall extending transversely to the axis of rotation of said image cylinder.

5. An erase unit according to claim 4 wherein said gas introducing means includes said second electrode, said second electrode comprising a tube having at least one aperture therein and one end adapted for connection to a source of gas whereby gas flows into said tube and through said one aperture into said region.

6. An erase unit according to claim 1 wherein said plenam extends in a direction parallel to the axis of rotation of said image cylinder a distance at least equal to the transverse extent of the image on the cylinder, said plenum including said dielectric, a pair of walls spaced one from the other and extending transversely along opposite sides of said dielectric and a pair of end walls, the distal edges of said side and end walls lying in close proximity to but spaced from the image cylinder surface.

7. An erase unit according to claim 6 wherein said gas introducing means includes said second electrode, said second electrode comprising a tube having a plurality of apertures spaced longitudinally one from the other along said tube and having one end adapted for connection to a source of gas whereby gas flows into said tube and through said apertures into said region within said plenum.

8. An erase unit according to claim 1 including means for mechanically clamping said second electrode and said dielectric one to the other.

9. An erase unit according to claim 1 wherein said first electrode is spaced further from said image cylinder surface than said second electrode.

10. An erase unit according to claim 1 wherein said circuit means provide a time-varying potential having a frequency of 0.2 to 50 mHz.

11. In an electrostatic ion deposition printer including an electrostatic print head for forming an electrostatic image, an image cylinder rotatable about an axis and having a dielectric layer for receiving the electrostatic image, means for transferring the image to a substrate and an erase unit, including first and second electrodes disposed adjacent a surface of said image cylinder at a location in opposition thereto and to the residual electrostatic potential remaining on said image cylinder and a dielectric disposed between said first and second electrodes, a method for removing residual electrostatic potential remaining on the image cylinder after the image has been transferred to the substrate, comprising the steps of:

introducing an inert gas in a region adjacent said second electrode and between said dielectric and said image cylinder surface; and providing a time varying potential across said electrodes to ionize the gas in said region and enable substantial equalization of the residual potential on said image cylinder surface and the potential on said second electrode.

12. A method according to claim 11 including holding the second electrode at ground potential to produce a zero potential on said image cylinder surface upon equalization of said potentials.

13. A method according to claim 11 including driving said second electrode with a DC bias whereby the residual image on the image cylinder surface is erased and the image cylinder surface is brought to a biased potential matching the potential of said second electrode.

14. A method according to claim 11 including pre-charging the image cylinder surface to a predetermined potential to provide a potential on said image cylinder surface after the residual electrostatic potential is removed.

15. A method according to claim 12 including forming a plenum having as one side thereof the image cylinder surface containing the residual electrostatic potential and introducing argon gas into said plenum.

16. A method according to claim 11 including providing a time-varying potential with a frequency of 0.2 to 50 mHz.

17. An erase unit for removing residual electrostatic potential of an image remaining on an image cylinder of an ion deposition printer after the image has been transferred to a substrate, comprising:

a plenum having first and second electrodes disposed adjacent a surface of the image cylinder at a location in opposition thereto and to the residual electrostatic potential remaining on the image cylinder;

a dielectric disposed between said first and second electrodes;

means for introducing an inert gas in said plenum in a region thereof adjacent said second electrode and between said dielectric and said image cylinder surface;

means for confining the inert gas in said region; and circuit means for providing a time varying potential across said electrodes to ionize the gas in said region and enable migration of ions in the gas toward the image cylinder surface to obtain substantial equalization of the residual potential on the image cylinder surface and a potential on said second electrode.

18. An erase unit according to claim 17 wherein said gas introducing means includes said second electrode, said second electrode comprising a tube having at least one aperture therein and one end adapted for connection to a source of gas whereby gas flows into said tube and through said one aperture into said region.

19. An erase unit according to claim 17 wherein said confining means includes said dielectric, a pair of walls spaced one from the other and extending transversely along opposite sides of said dielectric and a pair of end walls, the distal edges of said side and end walls lying in close proximity to but spaced from the image cylinder surface; said gas introducing means including said second electrode, said second electrode comprising a tube having a plurality of apertures spaced longitudinally one from the other along said tube and having one end adapted for connection to a source of gas whereby gas flows into said tube and through said apertures into said region within said confining means.

20. An erase unit according to claim 17 wherein said first electrode is spaced further from said image cylinder surface than said second electrode, said circuit means providing a time-varying potential having a frequency of 0.2 to 50 mHz.

* * * * *